US007111487B2

(12) United States Patent
Yong et al.

(10) Patent No.: US 7,111,487 B2
(45) Date of Patent: Sep. 26, 2006

(54) APPARATUS AND METHOD FOR FORMING CURVATURE IN SHEET METAL

(75) Inventors: Ming Shyan Yong, Singapore (SG); Chee Mun Choy, Singapore (SG); Meng Kwong Ho, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 117 days.

(21) Appl. No.: 10/691,420

(22) Filed: Oct. 22, 2003

(65) Prior Publication Data

US 2005/0086990 A1 Apr. 28, 2005

(51) Int. Cl.
*B21D 31/06* (2006.01)

(52) U.S. Cl. ..... 72/313; 72/379.2; 72/377; 72/307

(58) Field of Classification Search ..... 72/307, 72/377, 167, 312–314, 379.2, 474, 470, 356, 72/361, 352, 403, 184, 408, 412, 414, 415
See application file for complete search history.

(56) References Cited

U.S. PATENT DOCUMENTS

| | | | | | |
|---|---|---|---|---|---|
| 1,143,480 | A * | 6/1915 | Robinson | 152/82 |
| 1,659,776 | A * | 2/1928 | Langford | 72/376 |
| 1,761,888 | A * | 6/1930 | Junkers | 72/303 |
| 1,889,823 | A * | 12/1932 | Amos | 72/356 |
| 1,932,376 | A * | 10/1933 | Nyberg | 72/415 |
| 2,612,795 | A * | 10/1952 | Kaufmann | 72/361 |
| 2,958,362 | A * | 11/1960 | Creek | 72/412 |
| 3,153,844 | A * | 10/1964 | Theodor | 72/340 |
| 3,895,550 | A | 7/1975 | Daniels | |
| 4,274,275 | A * | 6/1981 | Battersby | 72/307 |
| 4,590,783 | A | 5/1986 | Tanaka et al. | |
| 4,833,904 | A * | 5/1989 | Mainiero | 72/11.2 |
| 5,148,694 | A | 9/1992 | Pearson et al. | |
| 5,253,501 | A * | 10/1993 | Spath | 72/167 |
| 6,643,930 | B1 * | 11/2003 | Issagholian-Havai | 29/890.149 |

FOREIGN PATENT DOCUMENTS

| | | |
|---|---|---|
| CA | 591363 | 1/1960 |
| WO | WO 00/32328 A1 | 8/2000 |

* cited by examiner

*Primary Examiner*—Daniel C. Crane
(74) *Attorney, Agent, or Firm*—Conley Rose, P.C.

(57) ABSTRACT

A curvature forming device has an upper member and a lower member. A clamping member is mounted on a spring within a recess in the upper member. An elongate deforming member is fixedly mounted in the same recess. The deforming member protrudes out of the recess more at one end than at the other. The upper member is pressed down against a flat anvil or die of a lower member, with a metal strip between them. The clamping member clamps the strip, whilst the deforming member deforms a small length of it. The upper member is raised and the strip moved forward a little bit. The upper member is then brought down again to clamp and deform the adjacent small length. Each deformed portion is generally fan shaped. These build up to produce a curve in the strip.

47 Claims, 5 Drawing Sheets

APPARATUS AND METHOD FOR FORMING CURVATURE IN SHEET METAL

FIELD OF THE INVENTION

The invention relates to forming a curvature in metal. In particular it relates to forming curvatures, for instance in a flat plane or compound curvatures, in sheet metal such as aluminum.

BACKGROUND OF THE INVENTION

The construction industry currently uses straight extruded aluminum plate modules fitted together to form building sunshields. However there is an increasing desire to use curved profile plates that blend onto buildings with concave and/or convex structures.

Curved aluminum strips have been created by cutting the curve out of a larger sheet of aluminum, but that is extremely wasteful of aluminum.

Extensive experimentation has been conducted 1 to roll flat aluminum plates with rollers to form metal plates with compound curvatures. However, with small processes the result is usually that the aluminum is undesirably deformed after being rolled. Published patents U.S. Pat. No. 5,148,694 and U.S. Pat. No. 5,253,501 and published patent application WO-A-00/32,328 all show a series of rollers to produce sheet metal with compound curvatures. However these processes are huge and require substantial investment to produce a particular curve. The systems are very inflexible to changes in curvature and require the change of several rollers if there is a change in specifications (radius or width).

SUMMARY OF THE INVENTION

According to one aspect of the present invention, there is provided a deforming apparatus for forming a curve in a deformable material (e.g. metal) member. The apparatus comprises a first member and a second member. The first member has a first member body and a first deforming portion. The first deforming portion extends in a first direction and has a first deforming end and a second deforming end. The second member has a second member body and a second deforming portion. The first and second members are arranged to receive a deformable material member between them in a second direction, transverse to the first direction. The first and second members are movable relatively towards each other to a first relative position to deform the deformable material member, in the first direction, with the first and second deforming portions. The first and second members are movable relatively away from each other to a second relative position. When the first and second members are in the first relative position, the first deforming end of the first deforming portion is closer to the second deforming portion than the second deforming end of the first deforming portion is to the second deforming portion.

According to another aspect of the present invention, there is provided a method of deforming a deformable material (e.g. metal) member having a width between two edges. The method comprises repeating a series of (a) positioning (b) deforming and (c) forwarding, a plurality of times. Positioning comprises positioning a first portion of the deformable material member in a deforming position between two deforming members. Deforming comprises deforming the portion of the deformable material member at said deforming position across the width of the deformable material member. Forwarding comprises forwarding the portion of the deformable material member at said deforming position out from the deforming position, after the deforming. During the deforming, one of the two edges of the deformable material member is compressed more than the other of the two edges of the deformable material member.

An exemplary embodiment of the invention includes a curvature forming device having an upper member and a lower member. A clamping member is mounted on a spring within a recess in the upper member. An elongate deforming member is fixedly mounted in the same recess. The deforming member protrudes out of the recess more at one end than at the other. The upper member is pressed down against a flat anvil or die of a lower member, with a metal strip between them. The clamping member clamps the strip, whilst the deforming member deforms a small length of it. The upper member is raised and the strip moved forward a little bit. The upper member is then brought down again to clamp and deform the adjacent small length. Each deformed portion is generally fan shaped. These build up to produce a curve in the strip.

INTRODUCTION TO THE DRAWINGS

The invention is now further described by way of non-limitative example, with reference to the accompanying drawings, in which.

SPECIFIC DESCRIPTION

Figure 1:
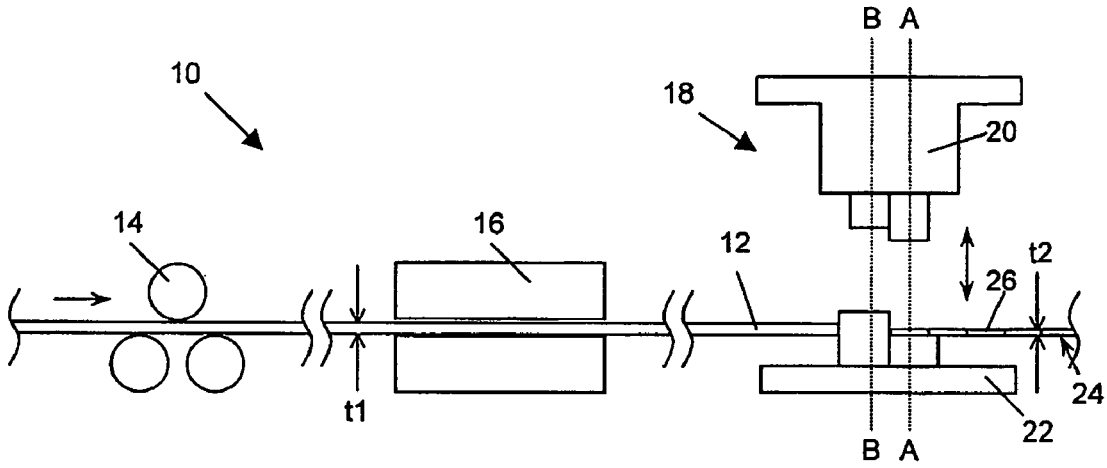
FIG. 1 is a side view of a machine for forming a curvature in a flat metal strip, using an embodiment of the invention.

Where the same reference numeral appears in separate drawings, it is intended to indicate the same element. References in the following description that relate to direction or orientation are with reference to the apparatus as shown in the drawings. If the apparatus is turned in any direction, then the directional and orientational references should also be considered to have changed as appropriate.

FIG. 1 shows various components of a machine 10 for forming a curvature in a flat metal strip 12, for instance an aluminum strip. The strip 12 enters from the left hand side as it appears in FIG. 1 and passes through a set of rollers 14, which is there to guide the strip 12. From the rollers 14, the strip 12 passes through an auto feeding device 16, which controls the feeding of the strip 12, in a stepwise manner. From the auto feeding device 16, the strip 12 passes through deforming apparatus in the form of a curvature forming device 18, having an upper member 20 and a lower member 22, where the strip 12 is deformed with the desired curvature, into a deformed strip 24. This involves the formation of a sequence of deformed portions 26 along the length of the strip 12.

When entering the auto feeding device 16, the strip 12 has a first thickness t1. During curvature formation, the thickness is reduced to thickness t2, which varies across the width of the strip 12. The variation in thickness across deformed portions 26 of the strip 12 cannot be seen in FIG. 1, nor can the curve, as the strip 12 would be curving out of the page in this embodiment.

Figure 2:
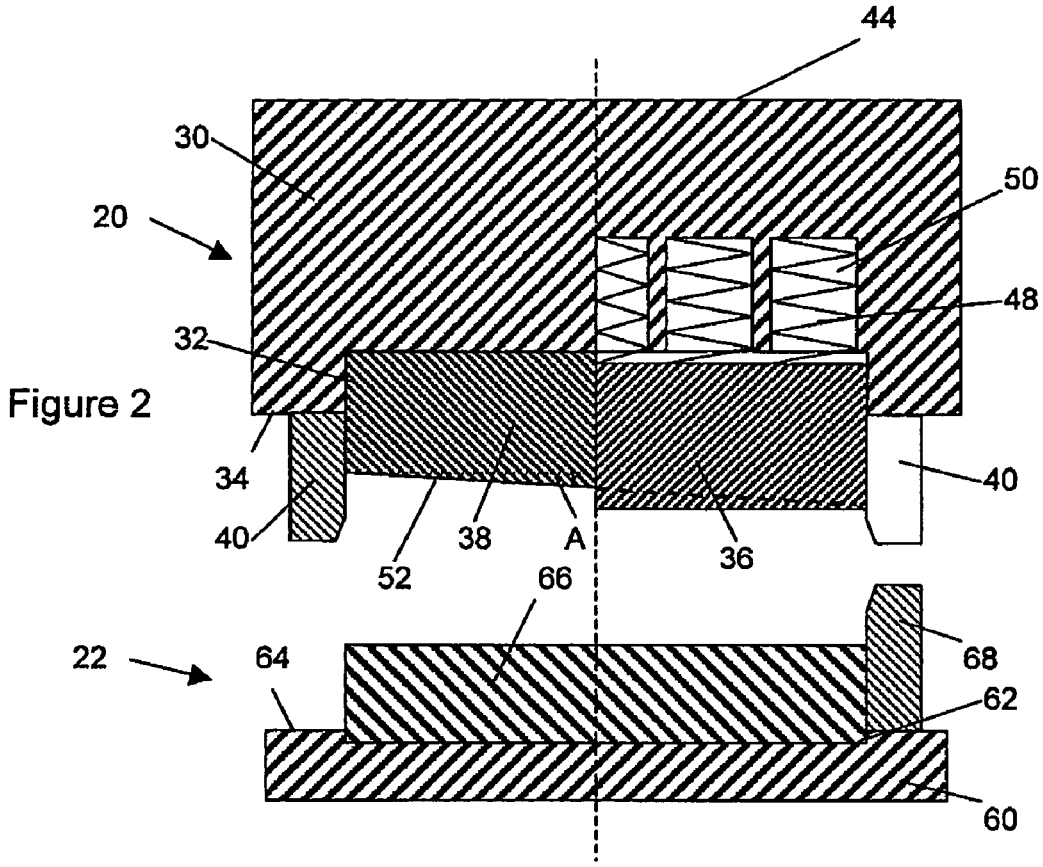
FIG. 2 is a mixed cross-section through the width of a curvature forming device according to a first embodiment of the invention.
Figure 3:
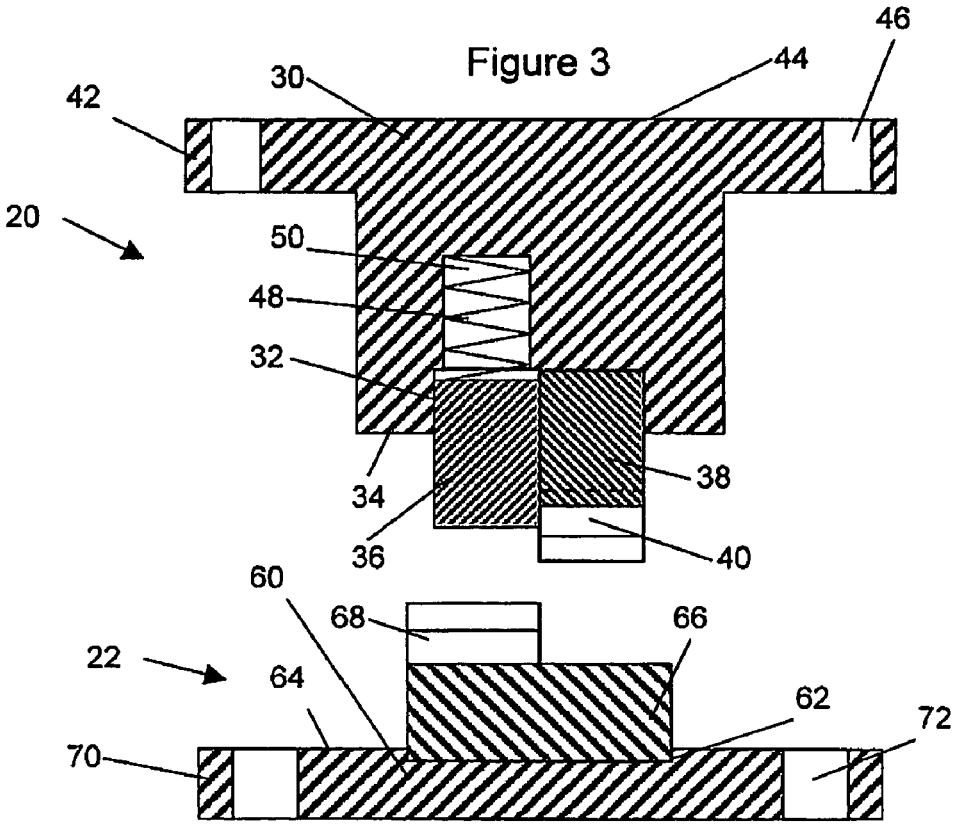
FIG. 3 is a cross-section through the length of the curvature forming device from the right side of FIG. 2.

FIG. 2 is a mixed cross-section through the width and FIG. 3 is a cross-section through the length of a first embodiment of the curvature forming device 18 of FIG. 1, from the right side of FIG. 2. The left side of FIG. 2 is the left side of a view through plane A—A in FIG. 1, whilst the right side of FIG. 2 is the right side of a view through plane B—B. in FIG. 1.

The upper member 20 has an upper member body portion 30, with a widthways (first direction) elongate tool recess 32 within a first side 34, being the underside in the orientation shown in the Figures. The tool recess 32 contains a first clamping portion in the form of an elongate upper clamp member 36 and a first deforming portion, in the form of an elongate hammer member 38, both extending in the widthways direction of the upper member 20 for the full extent of the tool recess 32 and both extending out of the tool recess 32 beyond the level of the underside 34 of the upper member body portion 30. The upper clamp member 36 and hammer member 38 are mounted side by side in their longitudinal directions within the tool recess 32.

A pair of upper guide members 40 sit on the underside 34 of the upper member body portion 30, one at each end of the tool recess 32, but not in the tool recess 32. The upper guide members 40 are the same width as the elongate hammer member 38. The upper guide members 40 are aligned with the elongate hammer member 38 and abut its ends.

A pair of flanges 42 extends outwards a second side 44 of the upper member body portion 30, being the top in the orientation shown in the Figures. The flanges 42 have through holes 46, which allow the upper member body portion 30 to be mounted onto a vertically movable press.

The upper clamp member 36 is mounted on compression springs 48, which sit above the upper clamp member 36 in separate spring recesses 50, recessed from the tool recess 32. Other resilient means could be used instead of compression springs, for instance resilient compressive materials, such as rubber or foam, compressive fluids, etc. The upper clamp member 36 is mounted within the tool recess 32 such that the upper surface of the upper clamp member 36 is a small distance away from the upper surface of the tool recess 32. This is achieved by way of bolts (not shown) passing through the upper member body portion 30 from its upper surface 44, down through the compression springs 48 into the upper clamp member 36. The bolts are not screwed into the upper member body portion 30, but just pass through it, and thus can move up and down with the upper clamp member 36, whilst their heads prevent the upper clamp member 36 from dropping out.

Thus, if an upward force is applied to the underside of the upper clamp member 36, the upper clamp member 36 moves upwards into the toll recess 32, until the upper surface of the upper clamp member 36 encounters the upper surface of the tool recess 32. The compression springs 48 act against any such upward force.

The hammer member 38 is fixedly but removably mounted within the tool recess 32 but cannot move in any direction relative to the tool recess 32 or upper member body portion 30. The hammer member 38 too is bolted (not shown) to the upper member body portion 30.

The upper clamp member 36 is cuboidal. The hammer member 38 is not quite cuboidal because its underside 52 is not level, but slopes from one end to the other, at a punch angle of C degrees. An exaggerated slope appears in FIGS. 2 and 3. Thus the hammer member 38 is deeper at the right end as shown in FIG. 2, than at the left end. The hammer member underside 52 is flat planar and thus this hammer member is a flat taper punch.

The lower member 22 has a lower member body portion 60, with a widthways elongate anvil recess 62 within a first side 64, being the topside in the orientation shown in the Figures. A second clamping portion and a second deforming portion, in this embodiment provided in an integral clamp and anvil member 66, is fixedly but removably mounted in the anvil recess 62 by bolts (not shown). The clamp and anvil member 66 is the same length as the upper clamp member 36 and the hammer member 38, but wider than the two of them combined. The clamp and anvil member 66 extends to the left of where the upper clamp member 36 extends in FIG. 3 and to the right of where the hammer member 38 extends in FIG. 3.

A pair of lower guide members 68 sit on the topside 64 of the lower member body portion 60, one at each end of the anvil recess 62, but not in the anvil recess 62. The lower guide members 68 start at the same position along the length of the lower member 22 as the clamp and anvil member 66 and extends to where the hammer member 38 in the upper member 20 begins. Thus there is no horizontal overlap between the upper and lower guide members 40, 68. The lower guide members 68 abut the ends of the clamp and anvil member 66.

In this embodiment the clamp and anvil member 66 is cuboidal and has its upper surface mounted parallel to the underside of the upper clamp member 36.

The lower member body portion 60 also has two flanges 70, one on either side, at its bottom surface. Through holes 72 allow the lower member 22 to be bolted down in position.

Deforming the strip 12 is achieved by bringing the upper member 20 of the curvature forming device 18 down upon the lower member 22 of the curvature forming device 18, with the strip in between. More particularly, as the upper member 20 is brought down, the underside of the upper clamp member 36 first comes into contact with the strip 12 lying on top of a clamp portion of the clamp and anvil member 66. Because the upper clamp member 36 is mounted on the springs 48 and allowed some upward movement into the upper member body portion 30, the upper member 20 can continue to move down without deforming the strip 12. Instead the upper member 20 achieves clamping of the strip 12.

After a little further movement, a first deforming end of the underside of the hammer member 38 comes into contact with the strip 12 lying on an adjacent, anvil portion of the top of the clamp and anvil member 66. However, the hammer member 38 cannot move up into the upper member body portion 30 and, as the lower side of the strip is against a first opposing portion of the anvil portion of the top of the clamp and anvil member 66, any further downward movement of the upper member 20 results in deformation of the strip 12. For this to happen, the components of the curvature forming device 18 are made of harder material than the strip 12 (e.g. steel for an aluminum strip).

The shapes of the hammer member 38 and anvil portion of the top of the clamp and anvil member 66 define the shape of the deformed portions 26 of the strip 12. In this case, the first deforming end (right side) of the hammer member 38, as it appears in FIG. 2, comes down further than the second deforming end (left side) does and the opposing portions of the anvil portion are at the same level. The only way that the right side of the strip 12 can deform in response is to spread out. The flat sheet is therefore compressed by the angular hammer member, causing a flat section to form into a fan shape, and with a series of these, form a desired curvature.

The amount that the strip has to spread out depends on the depth to which the underside 52 of the hammer member 38 has come. Thus the right side of the strip 12 spreads out further than the middle part and further still than the left side, as they appear in FIG. 2. The result is not only a variation in the thickness of the strip 12 across its width (in the first direction), but also the creation of a curve in the plane of the strip 12, as the length of the right side of the strip 12 is greater than the length of its left side. The slope "C" of the underside 52 of the hammer member 38, termed here the punch angle, affects the radius of the curve, as does the depth to which the hammer member 38 is pressed and the step feed distance (pitch). The greater the punch angle the smaller the radius of the curve. The step feed distance (pitch) should not exceed the width of the hammer member 38 and may be less to reduce or prevent the presence of ridges between adjacent deformed portions.

This deformation only occurs for the part of the strip between the hammer member 38 and anvil portion of the top of the clamp and anvil member 66. The deformation spreads little, if at all, to the part between the upper clamp member 36 and the clamp portion of the clamp and anvil member 66, due to the strip being firmly clamped. Nor can it spread sideways due to the presence of the upper and lower guide members 40, 68.

Figure 4:
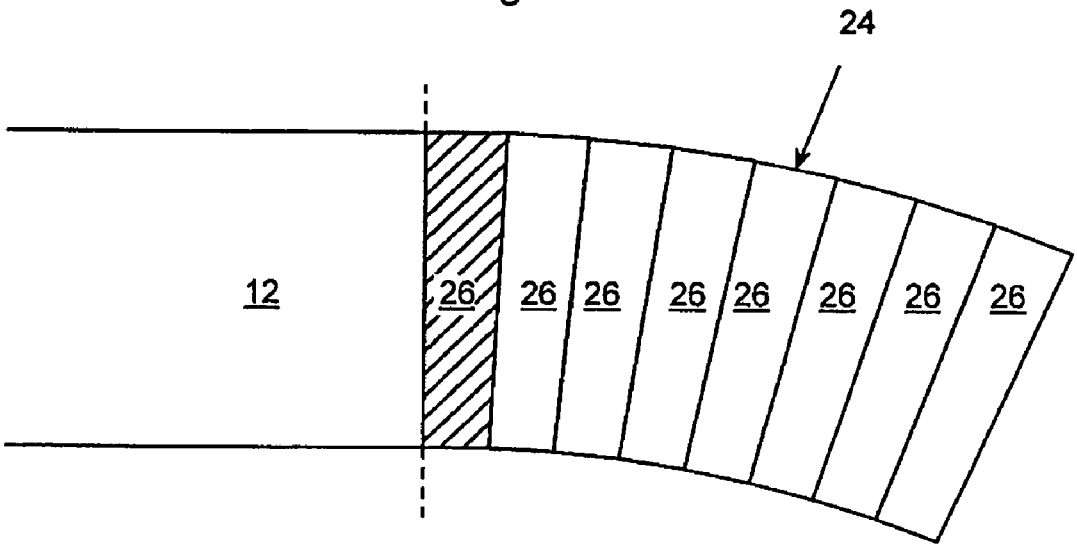
FIG. 4 is a plan view of a curved metal strip produced using apparatus in accordance with an embodiment of the invention.

Once one part of the strip has been deformed, the upper member 20 is raised and the strip 12 moved forward a little in a second direction, transverse to the first direction, before stopping again. The upper member 20 is then brought down again to deform this next length of strip 12, and so on. The results of this repeated process are shown in FIG. 4, where the curve builds up, based on a continuous sequence of deformed portions 26.

Figure 5:
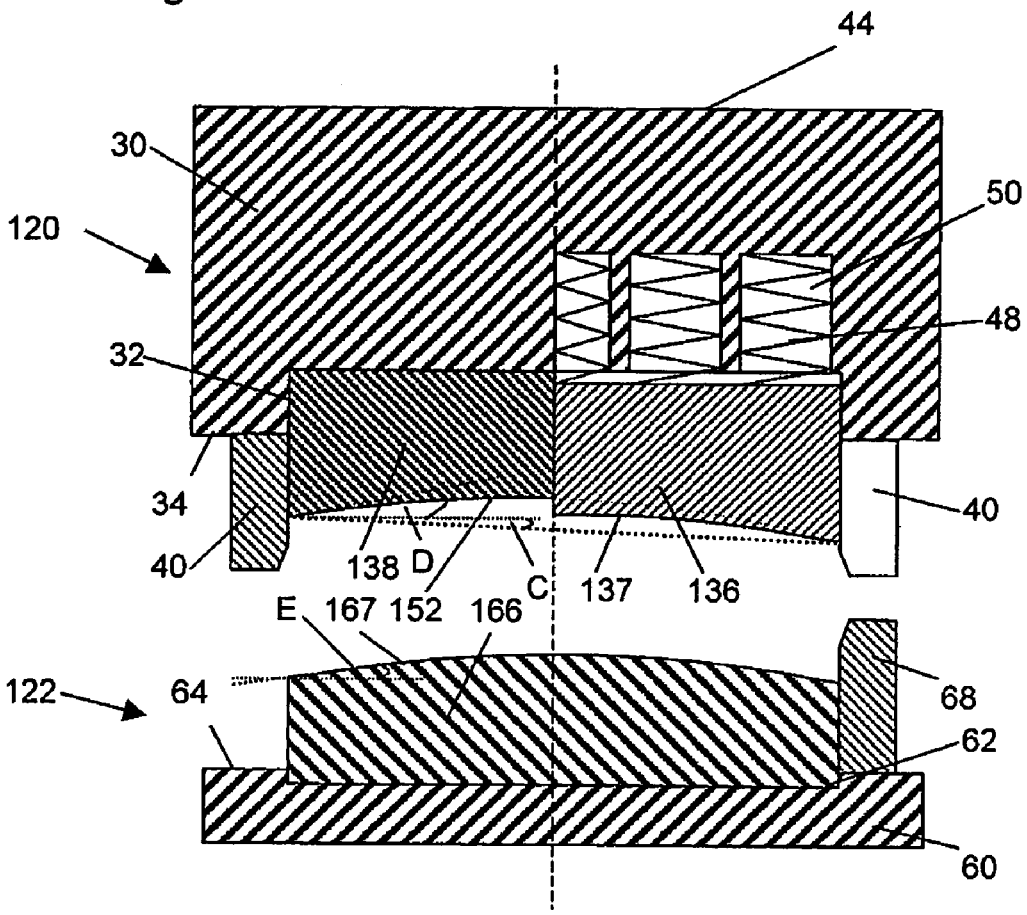
FIG. 5 is a mixed cross-section through the width of a curvature forming device according to a second embodiment of the invention.

FIG. 5 is a mixed cross-section through a second embodiment of the curvature forming device 18 of FIG. 1, where the curvature forming device is of another type. The left side of FIG. 2 is the left side of a view through plane A—A in FIG. 1, whilst the right side of FIG. 2 is the right side of a view through plane B—B in FIG. 1.

The curvature forming device of FIG. 5 is similar to that of FIGS. 2 and 3. The differences are in the designs of the hammer member 138 and the upper clamp member 136 of the upper member 120 and in the design of the clamp and anvil member 166 in the lower member 122. Thus most of the above description of the curvature forming device 18 of FIGS. 2 and 3 applies in respect of the curvature forming device of FIG. 5 and the same reference numbers are used accordingly.

The difference between the hammer member 36 of FIGS. 2 and 3 and the hammer member 138 of FIG. 5 is particularly in the shape of their undersides. In FIG. 5, the underside 152 of the hammer member 138 is curved concave, rather than flat planar. As with the hammer member 38 of FIGS. 2 and 3, the right hand side of the hammer member 138 of FIG. 5 extends further down than the left hand side. Thus, as with the use of the curvature forming device 18 of FIGS. 2 and 3, the first deforming end (right hand side) of the hammer member 138 of FIG. 5 comes into contact with the top of a strip before any other part of the hammer member 138 does. The hammer member underside 152 is curved and thus this hammer member is a curved taper punch. As before, when the hammer member is fully lowered, the first deforming end (right side) of the hammer member 138 is closer to its opposing portion of the clamp and anvil member 166, than the second deforming end (left side) of the hammer member 138 is to its opposing portion of the clamp and anvil member 166.

The hammer member underside 152 is partly defined in terms of the punch angle "C" of the underside 152 of the hammer member 138. This angle is based on the differences in levels of the ends of the hammer member underside 152, rather than following a straight surface. The hammer member underside 152 is also partly defined in terms of a radius of curvature. The hammer member underside 152 is additionally defined in terms of an elevation angle "D", which indicates the angle to the horizontal at which the hammer member underside 152 initially extends at its left hand end.

The top surface 167 of the clamp and anvil member 166 is also not flat, but is curved convex, the curve being in the widthwise direction of the lower member 122. There is no curve in the lengthwise direction of the lower member 122, that being the direction in which strips are fed. The top surface 167 of the clamp and anvil member 166 is symmetrical about its central lengthwise axis. The top surface 167 of the clamp and anvil member 166 is partly defined in terms of a radius of curvature and partly in terms of an elevation angle "E", which indicates the angle to the horizontal at which the top surface 167 initially extends at its left hand end. The underside 137 of the upper clamp member 136 as before is complementary to the top surface 167 of the clamp and anvil member 166. It is curved concave, matching the top surface 167 of the clamp and anvil member 166.

The radius of curvature partly defining the top surface 167 of the clamp and anvil member 166 is greater than the radius of curvature partly defining the hammer member underside 152. In general, the shape of a strip to be deformed by the curvature forming device should match that of the clamps. Thus the curvature forming device of FIG. 5 is most suited to a cambered strip.

In the embodiment shown in FIG. 5, the right hand end of the hammer member underside 152 is the lowest point of the hammer member underside 152. The highest point of the hammer member underside 152 is near the midpoint of the two ends, although closer to the left hand end than to the right hand end. The highest point of the top surface 167 of the clamp and anvil member 166 is the midpoint between the two ends (which is on the central lengthwise axis of the clamp and anvil member 166). The lowest points of the top surface 167 of the clamp and anvil member 166 are its two ends, which are at the same level as each other. The difference in height between the highest point and lowest points of the top surface 167 of the clamp and anvil member 166 is less than the difference in height between the highest point and lowest point of the hammer member underside 152.

As before, the shapes of the hammer member 138 and anvil portion of the top of the clamp and anvil member 166 define the shape of the deformed portions 26 of the strip 12. Again, as before, the right side of the hammer member 138, as it appears in FIG. 5, comes down to a lower point than the rest of the hammer member 138 does and the right side of the strip 12 deforms by spreading out further relative to the rest. The result is that the strip fans out in a direction transverse to the direction of motion of the hammer member 138, as with the flat taper punch. Where the strip is already curved, it now also curves in a second plane orthogonal to the plane of the strip. The overall result is therefore a compound curvature.

Figure 6:
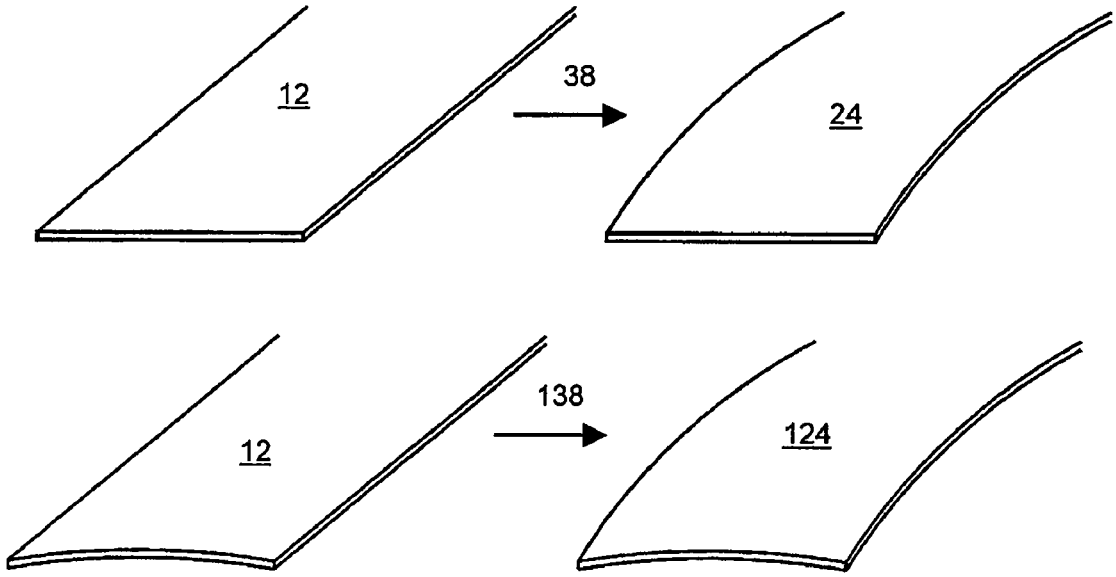
FIG. 6 is a view of the different shapes of the deformed strips produced according to the different curvature forming devices of the first and second embodiments.

The differences between the deformed strips produced according to the different curvature forming devices are shown in FIG. 6. The top row of FIG. 6 shows a pre-deformation strip 12 and a post-deformation strip 24 as deformed by a curvature forming device with a flat taper punch 38, whilst the bottom row of FIG. 6 shows a pre-deformation strip 12 and a post-deformation strip 124 as deformed by a curvature forming device with a curved taper punch 138.

The lower guide members guide the strip 12 as it passes through the curvature forming device 12. Additional, auxiliary guides (not shown) may also be provided. These are preferably rotatable bodies with circumferential recesses, the recesses abutting an edge of the strip. The auxiliary guides can be spaced at various points along the length of the strip. Where the strip is still straight, before the curvature forming device 12, the auxiliary guides may be positioned in pairs, one guide of each pair on either side of the strip, the two guides opposing each other. Where the strip is curved, after the curvature forming device 12, the auxiliary guides may be positioned in groups of three, with two of the guides of each group on the outside edge and the third guide of each group on the inside edge, roughly central relative to the two guides on the outside edge.

Figure 7:
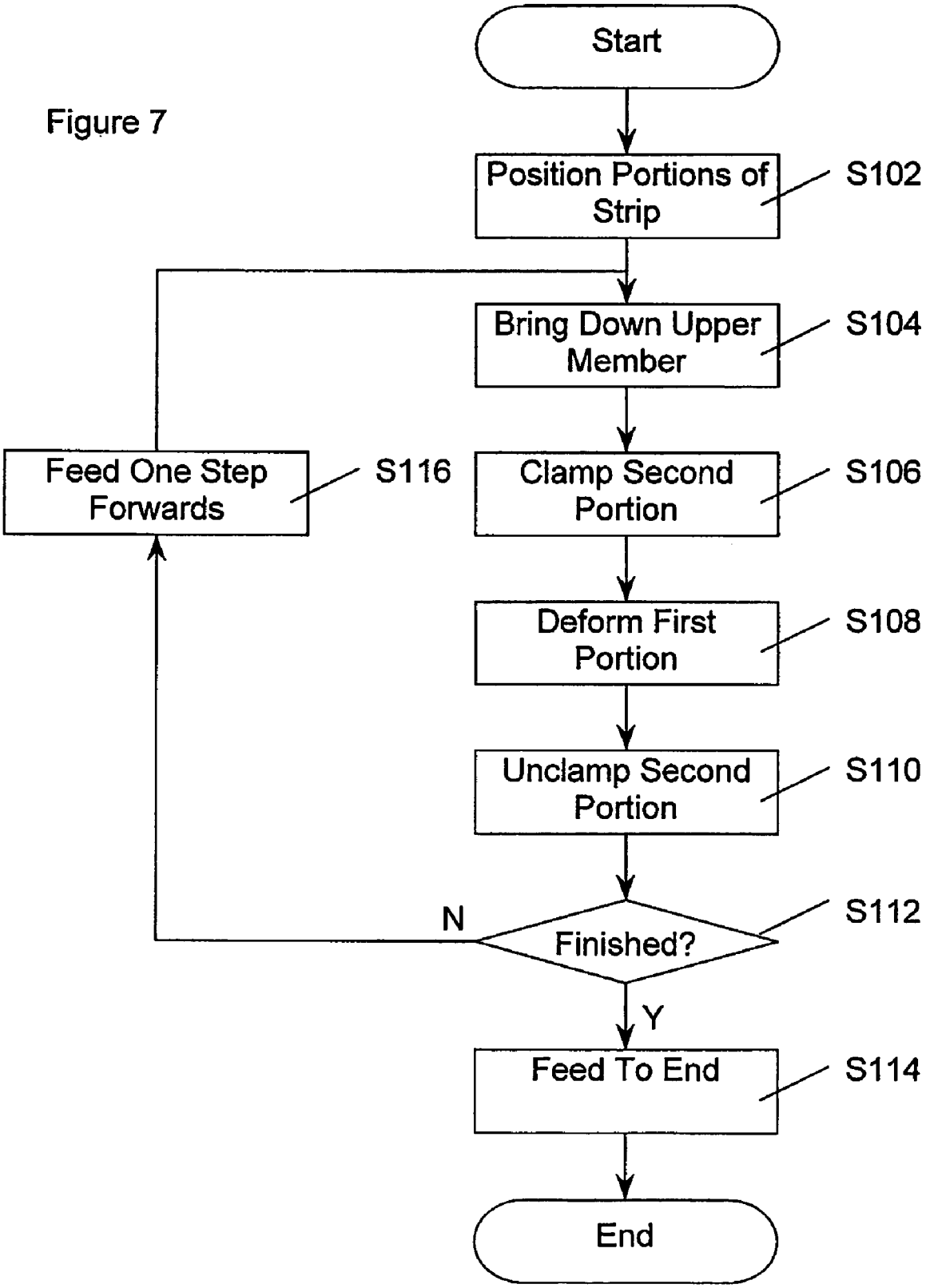
FIG. 7 is a flowchart showing steps in the deformation of a material according to another embodiment of the invention.

FIG. 7 is a flowchart showing steps in the deformation of a material according to another embodiment of the invention, for instance using the machine of FIG. 1, with the curvature forming device of FIGS. 2 and 3. A strip 12 of deformable material passes over rollers 14 and into an auto feeding device 16, which feeds it forwards to the curvature forming device 18. A first portion of the strip 12 is fed to a deforming position between the hammer member 38 and the anvil portion of the clamp and anvil member 66, whilst an adjacent second portion of the strip is fed to a clamping position between the upper clamp member 36 and the lower clamp portion of the clamp and anvil member 66 (Step S102). The upper member 20 of the curvature forming device 18 is brought down (Step S104). This leads to clamping of the second portion by the two clamp portions (Step S106) and deforming of the first portion of the strip by the hammer member 38 and the anvil portion of the clamp and anvil member 66 (Step S108).

After deforming, the upper member 20 of the curvature forming device 18 is raised (Step S110), thereby unclamping the second portion of the strip. A decision is made as to whether the process has finished (Step S112), in terms of curvature being formed in a sufficient length of material. If the process has finished, then the strip is fed through completely (Step S114) without further deformation and the process ends. Otherwise the strip is fed forward a step (Step S116), such that the first portion leaves the deforming position and is replaced at that position by the previous second portion that had been at the clamping position and a third portion of the strip, adjacent the second portion is fed to the clamping position. Thus, in effect, the old second portion of the strip becomes the new first portion of the strip and the old third portion of the strip becomes the new second portion of the strip.

The process then returns to the upper member being brought down, as before (Step S104). The process continues in this way until the decision is made (at Step S112) that the process has finished.

Experimental work was conducted using a 25-ton mechanical press to press down the upper member 20 of the curvature forming device 18 of the first embodiment, to evaluate the consistency of forming straight metal strip into profiles with flat or compound curvatures. Optical projection CMM techniques were used to measure the radii of the formed parts.

Figure 8:
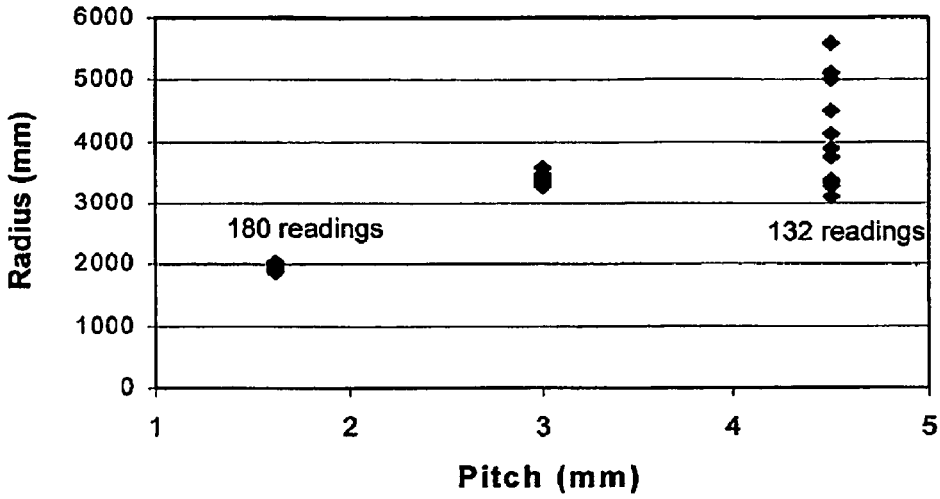
FIG. 8 is a graph showing the influence of stamping pitch on the formed radius using a first punch angle for flat section products.
Figure 9:
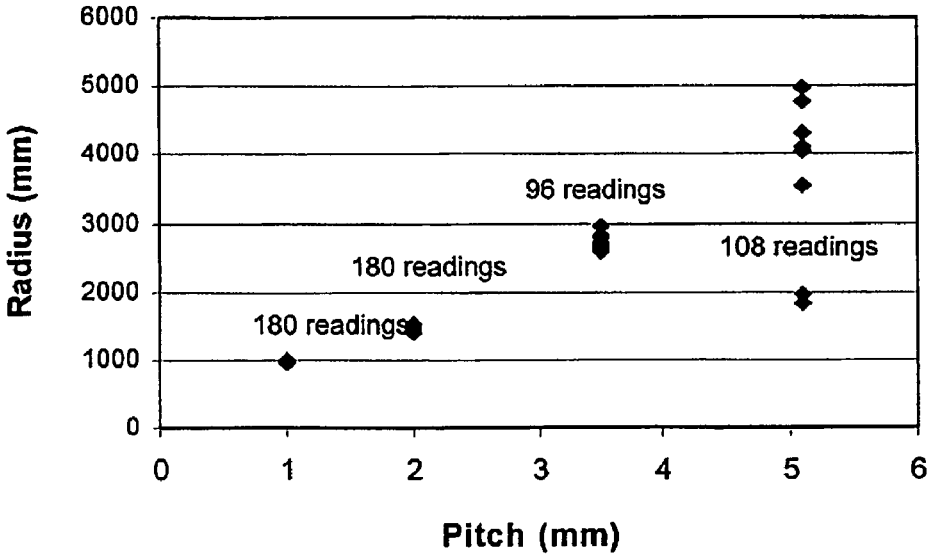
FIG. 9 is a graph showing the influence of stamping pitch on the formed radius using a second punch angle for flat section products.

FIGS. 8 and 9 are graphs displaying the pitch (step feed distance) vs radius results gathered from different flat taper punch experiments producing flat section parts within a curved strip. FIG. 8 is a graph showing the influence of stamping pitch (step feed distance between consecutive hammerings or punches) on the formed radius, using a 0.11 degree punch angle for flat section products, whilst FIG. 9 is a graph showing the results using a 0.2 degree punch angle. For both punch angles, parts formed using a smaller pitch display a more consistent radius compared with those using a larger pitch.

Figure 10:
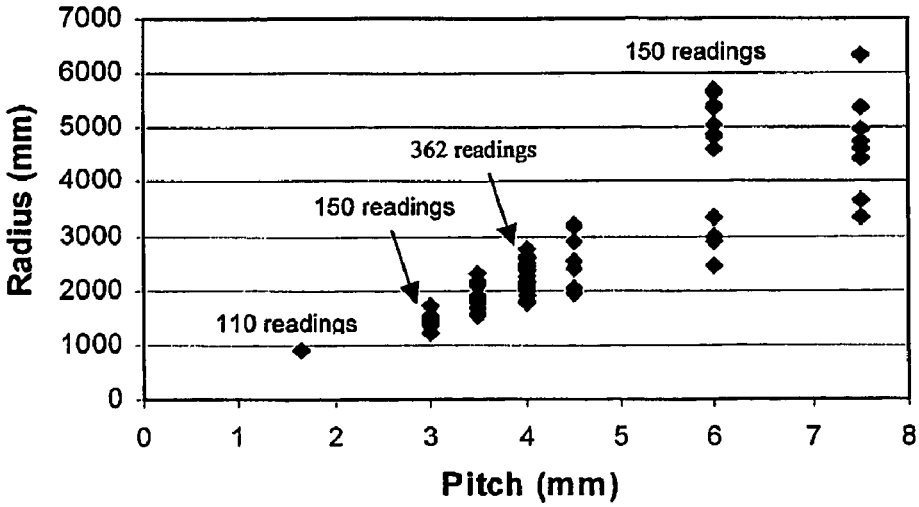
FIG. 10 is a graph showing the influence of stamping pitch on the formed radius using a third punch and die angle for curved section products.

FIG. 10 is a graph showing the influence of stamping pitch on the formed radius using a curved taper punch, with a 0.14° punch and die angle for curved section products. As with flat taper punches, parts formed using a smaller pitch display a more consistent radius compared with those using a larger pitch. However, the lack of consistency starts with smaller pitches for the curved taper punch, than for the flat taper punches. Even so, the results of the process are still usable.

Variations in shape, as desired, can be achieved by varying aspects of the hammer member and anvil portion. Clearly the direction of the curvature(s) can be reversed by turning the hammer member around within the curvature forming device (or by other appropriate methods). The punch angles and pitches can also vary, as can the radius of curvature of the underside of the hammer portion. The above embodiments have the variation in the hammer member, with a flat and level anvil portion. However, this position can be reversed, so that the hammer portion is flat and level. Further alternatives include shaping both the hammer member and anvil portion to achieve the desired curvature.

In the embodiment of FIG. 2, the clamping portions are flat and parallel and will produce little if any deformation in a flat strip. In the embodiment of FIG. 5, the clamping portions are curved and parallel and may produce some deformation in a flat strip. As such, it is preferred that the strip entering the curvature forming device of FIG. 5 is already cambered. It can be cambered already by the time it enters the curvature forming machine 10, for instance the camber may be formed when a strip is extruded. Alternatively, the upward camber may be formed using a standard device for doing this, such as a simple punch with curved hammer and curved anvil portions, between the entrance to the curvature forming machine 10 and the curvature forming device.

Another possibility is that the camber is formed by the upper and lower clamp members themselves. More specifically, the upper and lower clamp members (and the strip) start flat, as in the curvature forming device of FIG. 2. The upper and lower clamp members (and the strip) gradually change in shape in the second direction (that is the feed direction of the strip). By the time the strip is released to the hammer and anvil portion, the upper and lower clamp members are shaped as in the curvature forming device of FIG. 5. To achieve this, the length of the upper and lower clamp members in the second direction (that is the feed direction of the strip) may be increased, usefully to twice or more the length of the hammer member in the same direction. This may depend upon the metal, thickness and width of the target strips to be bent. In such a device, the upper and/or lower clamp members may each be made up of several separate sub-members, for ease of manufacture.

Additionally, whilst the upper clamp member 36, 136 in the above embodiments is resiliently mounted in the upper body member 20, 120, it may be the lower clamp member 66, 166 that is resiliently mounted, in the lower body member 60 (even if it is the upper hammer portion 38, 138 that is shaped. In a further alternative, both the upper and lower clamp members may be resiliently mounted. In such embodiments, the lower clamp member portion of the clamp and anvil member 66, 166 would be distinct from the anvil portion of the clamp and anvil member 66, 166. Separate lower clamp member portions and anvil portions can also be used in any of the above embodiments, preferably abutting each other.

The above described embodiments rely on the principle of compressing one edge of a strip more than the other edge. This causes the fan shape or curved plane (planar curve) which is not sufficiently feasible by extrusion and rolling.

The above described embodiments have the clamping portions within the curvature forming device. However, the clamping function (other than any than is intrinsic in the act of deformation) can be separated from that device. Any clamping could be provided in a similar manner to that described but in a separate device, either immediately adjacent the curvature forming device (for the same effect as in the above described embodiments) or at least slightly removed therefrom. Clamping can be before and/or after the curvature forming device. Some or sufficient clamping can, for instance, be provided by the rollers 14 of FIG. 1, either in the position as indicated or closer to the curvature forming device. Some or sufficient clamping can, for instance, be provided by the auto-feeding device 16 of FIG. 1, either in the position as indicated or closer to the curvature forming device.

In further embodiments of the invention there may be more than one curvature forming device. For instance two or more curvature forming devices may be used in series to augment each other and provide curvatures of a smaller radius, or to provide more complex shapes. Further different parts of a strip may be subjected to different deformations, for instance to produce an S-shape.

The preferred embodiments of the present invention are able to form flat or compound curvatures in sheets, particularly in flat metallic sheets with large width to thickness ratios (greater than 10:1). These embodiments are economical to construct, are flexible in allowing the production of several types of curvature requiring only the change of a single hammer member if there is a major change in specifications (radius or width) and produce no material wastage. The invention can be used for metal fabrications in the construction, aerospace and marine industries.

Many more variations can be made to the apparatus and process described above, without departing from the spirit and scope of the invention as defined in this specification and in particular in the accompanying claims.

The invention claimed is:

1. Deforming apparatus for forming a curve in a deformable material strip, the apparatus comprising:

a first member comprising a first member body and a first deforming portion, the first deforming portion extending in a first direction between a first deforming end and a second deforming end; and a second member comprising a second member body and a second deforming portion; wherein the first and second members are arranged to receive a deformable material strip between them in a second direction along the length of the deformable material strip and transverse to the first direction;

the first and second members are movable relatively towards each other to a first relative position to deform the deformable material strip with the first and second deforming portions;

the first and second members are movable relatively away from each other to a second relative position; and when the first and second members are in the first relative position, the first deforming end of the first deforming portion is closer to the second deforming portion than the second deforming end of the fist deforming portion is to the second deforming portion such that the deformable material strip is being curved in a first plane defined by the first direction and the second direction and without the deformable material strip being curved in a second plane orthogonal to the first plane and parallel to the second direction.

2. Deforming apparatus according to claim 1, wherein the second deforming portion has a first opposing portion for opposing the first deforming end of the first deforming portion and a second opposing portion for opposing the second deforming end of the first deforming portion; and when the first and second members are in the first relative position, the first deforming end of the first deforming portion is closer to the first opposing portion of the second deforming portion than the second deforming end of the first deforming portion is to the second opposing portion of the second deforming portion.

3. Deforming apparatus according to claim 1, wherein the first deforming portion has a first deforming surface for contacting the deformable material strip and the second deforming portion has a second deforming surface for contacting the deformable material strip; and the first and second deforming surfaces are not complementary to each other.

4. Deforming apparatus according to claim 3, wherein the first and second deforming surfaces are tapered relative to each other.

5. Deforming apparatus according to claim 3, wherein the first and second deforming surfaces are straight and sloped relative to each other.

6. Deforming apparatus according to claim 3, wherein the first deforming surface is concave and the second deforming surface is convex.

7. Deforming apparatus according to claim 6, wherein the first and second deforming surfaces are curved.

8. Deforming apparatus according to claim 1, wherein the first deforming portion is fixedly mounted within the first member.

9. Deforming apparatus according to claim 8, wherein the first deforming portion is removably mounted within the first member.

10. Deforming apparatus according to claim 1, wherein the second deforming portion is fixedly provided within the second member.

11. Deforming apparatus according to claim 1, wherein the second deforming portion has a first deforming end and a second deforming end and at least one of the fist and second deforming portions is planar between its first and second deforming ends.

12. Deforming apparatus according to claim 1, wherein the second deforming portion has a first end and a second end and at least one of the first and second deforming portions is concave between its first and second ends.

13. Deforming apparatus according to claim 1, wherein the first member further comprises a first clamping portion;

the second member further comprises a second clamping portion;

the first and second members are movable relatively towards each other to the first relative position for clamping the deformable material strip between the first and second clamping portions; and the first and second members are movable relatively away from each other to the second relative position for releasing the deformable material strip.

14. Deforming apparatus according to claim 13, wherein the first clamping portion is movable relative to the first member body and the fist deforming portion between a first relative clamp position and a second relative clamp position.

15. Deforming apparatus according to claim 14, wherein when the first and second members are in the first relative position and the first clamping portion, the first member body and the first deforming portion are in the first relative clamp position, the first clamping portion is closer to the second clamping portion than the first deforming portion is to the second deforming portion; and when the first and second members are in the first relative position and the first clamping portion, the first member body and the first deforming portion are in the second relative clamp position, the first clamping portion is further from the second clamping portion than the first deforming portion is from the second deforming portion.

16. Deforming apparatus according to claim 13, wherein the first and second clamping portions have first and second clamping surfaces, respectively, the first and second clamping surfaces being complementary to each other.

17. Deforming apparatus according to claim 16, wherein the first and second clamping surfaces are straight.

18. Deforming apparatus according to claim 16, wherein the first clamping surface is concave and the second clamping surface is convex.

19. Deforming apparatus according to claim 18, wherein the first and second clamping surfaces are curved.

20. Deforming apparatus according to claim 13, wherein the first clamping portion comprises a first clamping member resiliency mounted within the first member.

21. Deforming apparatus according to claim 20, wherein the first clamping member is mounted on one or more compression springs within the first member.

22. Deforming apparatus according to claim 13, wherein the second clamping portion is fixedly provided within the second member.

23. Deforming apparatus according to claim 13, wherein the first clamping portion and first deforming portion abut each other.

24. Deforming apparatus according to claim 13, wherein the second clamping portion and second deforming portion abut each other.

25. Deforming apparatus according to claim 13, wherein the second clamping portion and second deforming portion comprise portions of an integral clamp and anvil member.

26. Deforming apparatus according to claim 13, further comprising first guide means adjacent to at least one of the first and second clamping portions, protruding beyond that clamping portion in the direction of the other clamping portion.

27. Deforming apparatus according to claim 1, further comprising second guide means adjacent to at least one of the first and second deforming portions, protruding beyond that deforming portion in the direction of the other deforming portion.

28. Deforming apparatus according to claim 13, wherein the outer surface of the second clamping portion runs smoothly into the outer surface of the second deforming portion.

29. Deforming apparatus according to claim 1, further comprising a forwarding device for forwarding a deformable material strip into between the first and second members, in a stepwise manner.

30. Deforming apparatus according to claim 1, wherein the deformable material strip is a metal member.

31. Deforming apparatus according to claim 1, further comprising:

a third member comprising a third member body and a third deforming portion, the third deforming portion extending in a third direction and having a first deforming end and a second deforming end; and a fourth member comprising a fourth member body and a fourth deforming portion; wherein the third and fourth members are arranged to receive portions of the deformable material strip between them in a fourth direction, transverse to the third direction, after the portions of the deformable material strip have been deformed by the first and second deforming portions;

the third and fourth members are movable relatively towards each other to a third relative position to deform the deformable material strip further, in the third direction, with the third and fourth deforming portions;

the third and fourth members are movable relatively away from each other to a fourth relative position; and when the third and fourth members are in the third relative position, the first deforming end of the third deforming portion is closer to the fourth deforming portion than the second deforming end of the third deforming portion is to the fourth deforming portion.

32. A method of deforming a deformable material strip having a width between two edges, the method comprising:

(a) positioning a first portion of the deformable material strip in a deforming position between two deforming members, the two deforming members being movable relatively towards each other to a first relative position to deform the deformable material strip and being movable relatively away from each other to a second relative position;

(b) deforming the portion of the deformable material strip at said deforming position along a first direction across the width of the deformable material strip by moving the two deforming members to the first relative position;

(c) moving the two deforming members to the second relative position and forwarding the portion of the deformable material strip out from the deforming position in a second direction after; and repeating the series of deforming and forwarding a plurality of times;

wherein during the deforming, one of the two edges of the deformable material strip is compressed more than the other of the two edges of the deformable material strip such that the deformable material strip is curved in a first plane defined by the first and second directions and without curving the deformable material strip in a second plane orthogonal to the first plane and parallel to the second direction.

33. A method according to claim 32, wherein (a) further comprises positioning a second portion of the deformable material strip in a clamping position between two clamping members; and the method further comprises:

clamping the portion of the deformable material strip at said clamping position before the deforming; and unclamping the portion of the deformable material strip at said clamping position after the deforming;

(b) further comprises forwarding the portion of the deformable material strip at said clamping position to the deforming position, and a portion of the deformable material strip adjacent to the portion of the deformable material strip at said clamping position to the clamping position, after the unclamping; and the method further comprises repeating the clamping and unclamping a plurality of times, such that the series of clamping, deforming, unclamping and forwarding is repeated a plurality of times.

34. A method according to claim 32, wherein the difference in compression between the two edges of the deformable material strip is linear across its width.

35. A method according to claim 32, wherein the difference in compression between the two edges of the deformable material strip is nonlinear across its width.

36. A method according to claim 32, wherein the deforming deforms the portion of the deformable material strip at said deforming position into a fan shape.

37. A method according to claim 32, wherein the deformable material strip is flat and extends in a first plane prior to deformation.

38. A method according to claim 37, wherein consecutive deformed portions of the deformable material strip forwarded out from the deforming position form a curve in the deformable material strip in at least the first plane.

39. A method according to claim 33, wherein the deforming occurs during the clamping.

40. A method according to claim 33, wherein the first and second portions of the deformable material strip are distinct from each other.

41. A method according to claim 32, wherein the deformable material strip is a metal member.

42. A method according to claim 32, further comprising:

positioning the deformed first portion of the deformable material strip in a second deforming position between two further deforming members after the first portion has been forwarded from the first deforming position;

further deforming the first portion of the deformable material strip at said second deforming position across the width of the deformable material strip;

forwarding the further deformed first portion of the deformable material strip at said second deforming position out From the second deforming position, after the further deforming; and repeating the series of further deforming and forwarding the further deformed first portion a plurality of times;

wherein during the further deforming, one of the two edges of the deformable material strip is compressed more than the other of the two edges of the deformable material strip.

43. Deforming apparatus for forming a curve in deformable material strip, the apparatus comprising:

a first member comprising a first member body and a first deforming portion, the first deforming portion extending in a first direction and having a first deforming end and a second deforming end; and a second member comprising a second member body and a second deforming portion; wherein the first and second members are arranged to receive a deformable material strip between them in a second direction along the length of the deformable material strip and transverse to the first direction;

the first and second members are movable relatively towards each other to a first relative position to deform the deformable material strip, in the first direction, with the first and second deforming portions;

the first and second members are movable relatively away from each other to a second relative position; and when the first and second members are in the first relative position, the first deforming end of the first deforming portion is closer to the second deforming portion than the second deforming end of the fist deforming portion is to the second deforming portion such that the deformable material strip is curved in a plane substantially perpendicular to the first direction and such that a cross-sectional shape of the deformable material strip is substantially maintained;

wherein the first member further comprises a first clamping portion;

the second member further comprises a second clamping portion;

the first and second members are movable relatively towards each other to the first relative position for clamping the deformable material strip between the first and second clamping portions; and the first and second members are movable relatively away from each other to the second relative position for releasing the deformable material.

44. Deforming apparatus for forming a curve in deformable material strip, the apparatus comprising:

a first member comprising a first member body and a first deforming portion, the first deforming portion extending in a first direction and having a first deforming end and a second deforming end; and a second member comprising a second member body and a second deforming portion; wherein the first and second members are arranged to receive a deformable material strip between them in a second direction along the length of the deformable material strip and transverse to the first direction;

the first and second members are movable relatively towards each other to a first relative position to deform the deformable material strip, in the first direction, with the first and second deforming portions;

the first and second members are movable relatively away from each other to a second relative position; and when the first and second members are in the first relative position, the first deforming end of the first deforming portion is closer to the second deforming portion than the second deforming end of the first deforming portion is to the second deforming portion such that the deformable material strip is curved in a plane substantially perpendicular to the first direction and such that a cross-sectional shape of the deformable material strip is substantially maintained; and further comprising a forwarding device for forwarding a deformable material strip into between the first and second members, in a stepwise manner.

45. Deforming apparatus for forming a curve in deformable material strip, the apparatus comprising:

a first member comprising a first member body and a first deforming portion, the first deforming portion extending in a first direction and having a first deforming end and a second deforming end; and a second member comprising a second member body and a second deforming portion; wherein the first and second members are arranged to receive a deformable material strip between them in a second direction along the length of the deformable material strip and transverse to the first direction;

the first and second members are movable relatively towards each other to a first relative position to deform the deformable material strip, in the first direction, with the first and second deforming portions;

the first and second members are movable relatively away horn each other to a second relative position; and when the first and second members are in the first relative position, the first deforming end of the first deforming portion is closer to the second deforming portion than the second deforming end of the first deforming portion is to the second deforming portion such that the deformable material strip is curved in a plane substantially perpendicular to the first direction and such that a cross-sectional shape of the deformable material strip is substantially maintained; and further comprising:

a third member comprising a third member body and a third deforming portion, the third deforming portion extending in a third direction and having a first deforming end and a second deforming end; and a fourth member comprising a fourth member body and a fourth deforming portion; wherein the third and fourth members are arranged to receive portions of the deformable material strip between them in a fourth direction, transverse to the third direction, after the portions of the deformable material strip have been deformed by the first and second deforming portions;

the third and fourth members are movable relatively towards each other to a third relative position to deform the deformable material strip further, in the third direction, with the third and fourth deforming portions;

the third and fourth members are movable relatively away from each other to a fourth relative position; and when the third and Fourth members are in the third relative position, the first deforming end of the third deforming portion is closer to the fourth deforming portion than the second deforming end of the third deforming portion is to the fourth deforming portion.

46. A method of deforming a deformable material strip having a width between two edges, the method comprising:

(a) positioning a first portion of the deformable material strip in a deforming position between two deforming members, the two deforming members being movable relative towards each other to first relative position to deform a deformable material strip and being movable relatively away from each other to a second relative position;

(b) deforming the portion of the deformable material strip at said deforming position along a first direction across the width of the deformable material strip;

(c) moving the two deforming members to the second relative position and forwarding the portion of the deformable material strip from the deforming position; and (d) repeating the series of deforming and forwarding a plurality of times;

wherein during the deforming, one of the two edges of the deformable material strip is compressed more than the other of the two edges of the deformable material strip such that the deformable material strip is curved in a plane substantially parallel to the first direction;

wherein the difference in compression between the two edges of the deformable material strip is non-linear across its width.

47. A method of deforming a deformable material strip having a width between two edges, the method comprising:

(a) positioning a first portion of the deformable material strip in a deforming position between two deforming members;

(b) deforming the portion of the deformable material strip at said deforming position along a first direction across the width of the deformable material strip;

(c) forwarding the portion of the deformable material strip at said deforming position out from the deforming position, after the deforming; and repeating the series of deforming and forwarding a plurality of times;

wherein during the deforming, one of the two edges of the deformable material strip is compressed more than the other of the two edges of the deformable material strip such that the deformable material strip is curved in a plane substantially perpendicular to the first direction and such that a cross-sectional shape of the deformable material strip is substantially maintained the method further comprising:

positioning the deformed first portion of the deformable material strip in a second deforming position between two further deforming members after the first portion has been forwarded from the first deforming position;

further deforming the first portion of the deformable material strip at said second deforming position across the width of the deformable material strip;

forwarding the further deformed first portion of the deformable material strip at said second deforming position out from the second deforming position, after the further deforming; and repeating the series of further deforming and forwarding the further deformed first portion a plurality of times;

wherein during the further deforming, one of the two edges of the deformable material strip is compressed more than the other of the two edges of the deformable material strip.

* * * * *